US007959314B1

(12) United States Patent
Rodriguez

(10) Patent No.: US 7,959,314 B1
(45) Date of Patent: Jun. 14, 2011

(54) ILLUMINABLE HAND-SIGNALING GLOVE AND ASSOCIATED METHOD

(76) Inventor: William Rodriguez, Chula Vista, CA (US)

( * ) Notice: Subject to any disclaimer, the term of this patent is extended or adjusted under 35 U.S.C. 154(b) by 462 days.

(21) Appl. No.: 12/218,565

(22) Filed: Jul. 16, 2008

Related U.S. Application Data

(60) Provisional application No. 60/963,388, filed on Aug. 6, 2007.

(51) Int. Cl.
*F21V 21/40* (2006.01)
*G08B 5/00* (2006.01)
*A41D 19/00* (2006.01)

(52) U.S. Cl. ..... 362/103; 340/321; 2/160

(58) Field of Classification Search ..... 362/103; 340/321; 2/160
See application file for complete search history.

(56) References Cited

U.S. PATENT DOCUMENTS 1,046,225 A * 12/1912 Schindler ..... 340/321
1,199,710 A * 9/1916 Newton ..... 340/321
1,230,943 A * 6/1917 Sundh ..... 362/103
5,086,378 A * 2/1992 Prince ..... 362/103
5,177,467 A * 1/1993 Chung-Piao ..... 362/103
6,006,357 A 12/1999 Mead
6,529,121 B2 * 3/2003 Bush ..... 340/321
6,592,235 B1 * 7/2003 Mayo ..... 362/103
6,709,142 B2 3/2004 Gyori
6,711,746 B1 3/2004 Orellana
6,992,572 B1 * 1/2006 Lovegrove ..... 340/432
7,503,667 B2 * 3/2009 Wilkings ..... 362/103
2008/0218996 A1 * 9/2008 Galloway et al. ..... 362/103

* cited by examiner

*Primary Examiner* — Alan Cariaso

(57) ABSTRACT

An illuminable hand-signaling glove preferably includes a body adapted to be positioned at a hand region of the user. Such a body may include a glove. The body may further include a wrist band and a plurality of finger bands connected thereto. The device may further include a plurality of light-emitting sources displayed on an exterior surface of the body, and a mechanism may be included for selectively toggling independent ones of the light-emitting sources between illuminated and non-illuminated modes by selectively pivoting one metacarpal of the user hand region along a plurality of positions defined within the body while maintaining remaining metacarpals of the user hand region at a static position. Such a selectively toggling mechanism preferably includes a manually actuated user interface attached to the exterior surface of the body.

13 Claims, 11 Drawing Sheets

ILLUMINABLE HAND-SIGNALING GLOVE AND ASSOCIATED METHOD

CROSS REFERENCE TO RELATED APPLICATIONS

This application claims the benefit of U.S. Provisional Application No. 60/963,388, filed Aug. 6, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to hand-signaling gloves and, more particularly, to an illuminable hand-signaling glove for displaying an intended user travel path.

2. Prior Art

While cycling on public roads, it is frequently desired to communicate with other pedestrians, drivers and cyclists on the road. In the absence of expensive and sophisticated equipment, such communication typically involves hand signals. But in order to convey a message in this manner, it is first necessary to get the other persons attention. This is frequently a problem if the other persons are not looking at the cyclist wishing to convey the message, or at least in their general direction, and this is particularly a problem in situations where visibility is limited, such as at nighttime. Cyclists have been known to place light reflectors on their bicycles and to wear reflective garments in order to increase their visibility. Although effective in their intended purposes, there are two major shortcomings of such reflective apparatuses. For one, they only become reflective when light strikes them at the correct angle, and secondly, they can not effectively be used by a person to indicate where they intend to turn.

U.S. Pat. No. 6,006,357 to Mead discloses a signaling glove that includes a body portion that is worn on a user's hand and at least one reflective surface mounted on the body portion. In some embodiments, the glove further includes a light source with a light-emitting unit adapted to illuminate the reflective surface. The light-emitting unit is preferably housed within a pocket formed at least in part by the reflective surface. When the light-emitting unit is housed within the pocket, the reflective surface includes a transparent or translucent region overlying the light. The reflective surface may be adjustably positionable on the body portion of the glove to enable a user to interchange the reflective surfaces and to orient the reflective surface to best fit the user's current signaling or other needs. Unfortunately, this prior art example is not designed for convenient use with all forms of self-guided transportation.

U.S. Pat. No. 6,709,142 to Gyori discloses a illuminated glove that has an outside layer, an inside liner and a fibre-optic arrangement mounted there between. This fibre-optic arrangement comprises fibre-optic ribbons extending along the fingers of the glove under the outside layer. Portions of these ribbons are visible through openings in the outside layer. A light source is mounted at the base of the thumb. A power source including a battery and a pressure sensitive switch is mounted in the cuff of the glove. A plurality of optical fibres extends loosely over the back-of-the-hand portion and the hand-knuckle region of the glove between the light source and the fibre-optic ribbons. A slack or loose bend is provided in the plurality of optical fibres for reducing hand stiffness and fibre tension when the fingers of the glove are flexed. Preferably, the slack or the loose bend is an offset between and relative to the light source and the fingers. Unfortunately, this prior art example does not display a sequence of bright flashing lights.

U.S. Pat. No. 6,711,746 to Orellana discloses a glove apparatus for emitting light in an area around the hand of the user. The glove apparatus includes a body member comprising a perimeter wall. The perimeter wall defines an interior space of the body member. The interior space of the body member is designed for selectively receiving the hand of the user. A plurality of light emitting assemblies is positioned in the perimeter wall of the body member. Each of the light emitting assemblies is designed for emitting light to illuminate an area around the hand of the user. Unfortunately, this prior art example does not conveniently include both glove and wrist-band versions.

Accordingly, the present invention is disclosed in order to overcome the above noted shortcomings. The illuminable hand-signaling glove is convenient and easy to use, lightweight yet durable in design, and designed for displaying an intended user travel path. The device is simple to use, inexpensive, and designed for many years of repeated use.

BRIEF SUMMARY OF THE INVENTION

In view of the foregoing background, it is therefore an object of the present invention to provide an apparatus for displaying an intended user travel path. These and other objects, features, and advantages of the invention are provided by an illuminable hand-signaling glove, as described hereinbelow.

A preferred embodiment of an illuminable hand-signaling glove preferably includes a body effectively adapted to be positioned at a hand region of the user. Such a body may include a glove. In alternate embodiments of the device, the body may further include a wrist band and a plurality of finger bands connected thereto. A first one of the finger bands is preferably longitudinally oriented away from the wrist band and may terminate distally therefrom. A second one of the finger bands may be statically and removably conjoined to proximal and distal sections of the first finger band respectively.

The preferred embodiment of the device may further include a plurality of light-emitting sources conveniently displayed on an exterior surface of the body and preferably juxtaposed along a uniform pattern. A mechanism may be included for selectively toggling independent ones of the light-emitting sources between illuminated and non-illuminated modes by selectively pivoting one metacarpal of the user hand region along a plurality of positions defined within the body while maintaining remaining metacarpals of the user hand region at a static position. Such a selectively toggling mechanism preferably includes a manually actuated user interface attached to the exterior surface of the body.

The selectively toggling mechanism may further include an internal power source, first and second rectilinear levers advantageously seated inside a cavity of the body, and a pivot pin cooperatively attached directly to first ends of the first and second levers respectively and thereby may synchronously pivot the first and second levers along mutually exclusive arcuate paths defined with the cavity of the body. The selectively toggling mechanism may further include a conductive head fixedly coupled to a second end of the second lever and electrically attached to the internal power source, and a conductive manifold preferably has a plurality of sockets formed along an inner surface thereof.

The selectively toggling mechanism may further include first and second deformably resilient spring members effectively anchored to oppositely facing flanges of the conductive manifold and the second lever respectively. Such first and second spring members are preferably respectively compressed and expanded as the second lever is articulated along the second mutually exclusive arcuate path such that the second lever is automatically returned to equilibrium when the one user metacarpal is disengaged from the first lever.

The first lever is preferably maintained in direct engagement with the one user metacarpal such that the first lever may be conveniently pivoted along a first one of the mutually exclusive arcuate paths and thereby may cause the second lever to synchronously pivot along a second one of the mutually exclusive arcuate paths respectively. In addition, one of the sockets is preferably formed from non-conductive material and may remain in direct abutment with the conductive head while the first and second springs as well as the second lever may be at equilibrium and thereby preferably maintain the light-emitting sources at the non-illuminated mode respectively. Remaining ones of the sockets may be formed from conductive material and may further be electrically coupled to a corresponding one of the light-emitting sources respectively. The conductive head is preferably selectively engaged with independent ones of the conductive sockets when the second lever is pivoted along the second mutually exclusive arcuate path away from equilibrium and thereby may independently transmit power to the corresponding light-emitting sources respectively.

In an alternate embodiment of the devise, the body may include the glove where a single array of light emitting sources is displayed. Such an embodiment of the device may be presented wherein the glove may include finger receiving sleeves.

In another embodiment of the device, the body may include the glove with the light emitting sources displayed in a variety of different quantities and patterns.

Additional embodiments of the device may include the body that preferably features a wrist band. The wrist band may include the array of light emitting sources. The body may also feature a wrist band and a plurality of finger bands connected thereto. A first one of the finger bands may be longitudinally oriented away from the wrist band and may terminate distally therefrom. A second one of the finger bands may be statically and removably conjoined to proximal and distal sections of the first finger band respectively.

A preferable method for illuminating a hand-signaling glove and thereby displaying an intended user travel path may include the steps of: providing a body; providing and juxtaposing a plurality of light-emitting sources along a uniform pattern by displaying the light-emitting sources on an exterior surface of the body; providing and attaching a manually actuated user interface to the exterior surface of the body; positioning the body at a hand region of the user; and selectively toggling independent ones of the light-emitting sources between illuminated and non-illuminated modes by selectively pivoting one metacarpal of the user hand region along a plurality of positions defined within the body while maintaining remaining metacarpals of the user hand region at a static position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figures 1A, 1B:
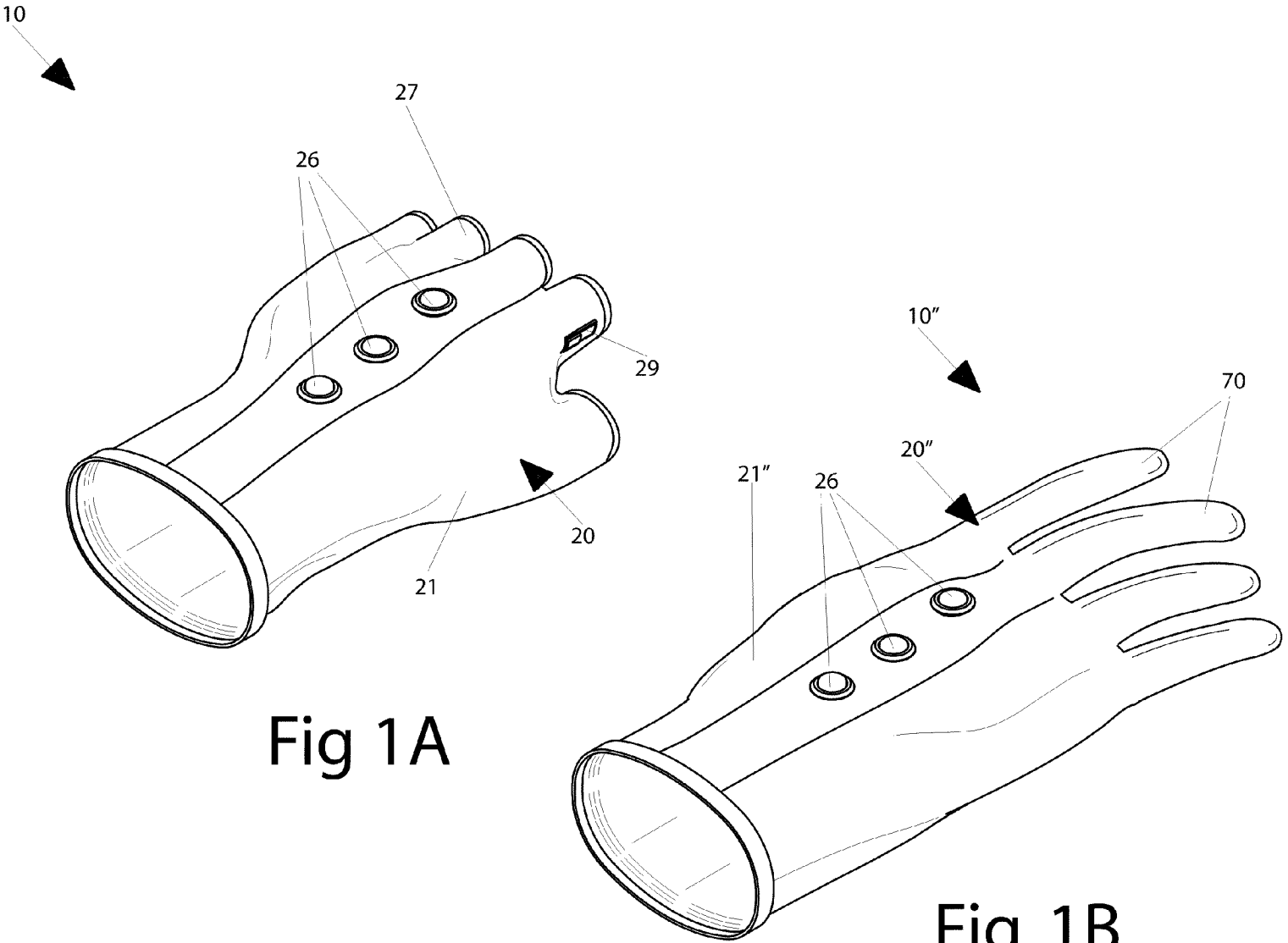
FIG. 1A is a perspective view showing a preferred embodiment of the illuminable hand-signaling glove wherein a single array of light emitting sources is displayed on the glove.
FIG. 1B is perspective view showing an alternate embodiment of the illuminable hand-signaling glove wherein the glove has extended finger receiving sleeves.
Figure 2:
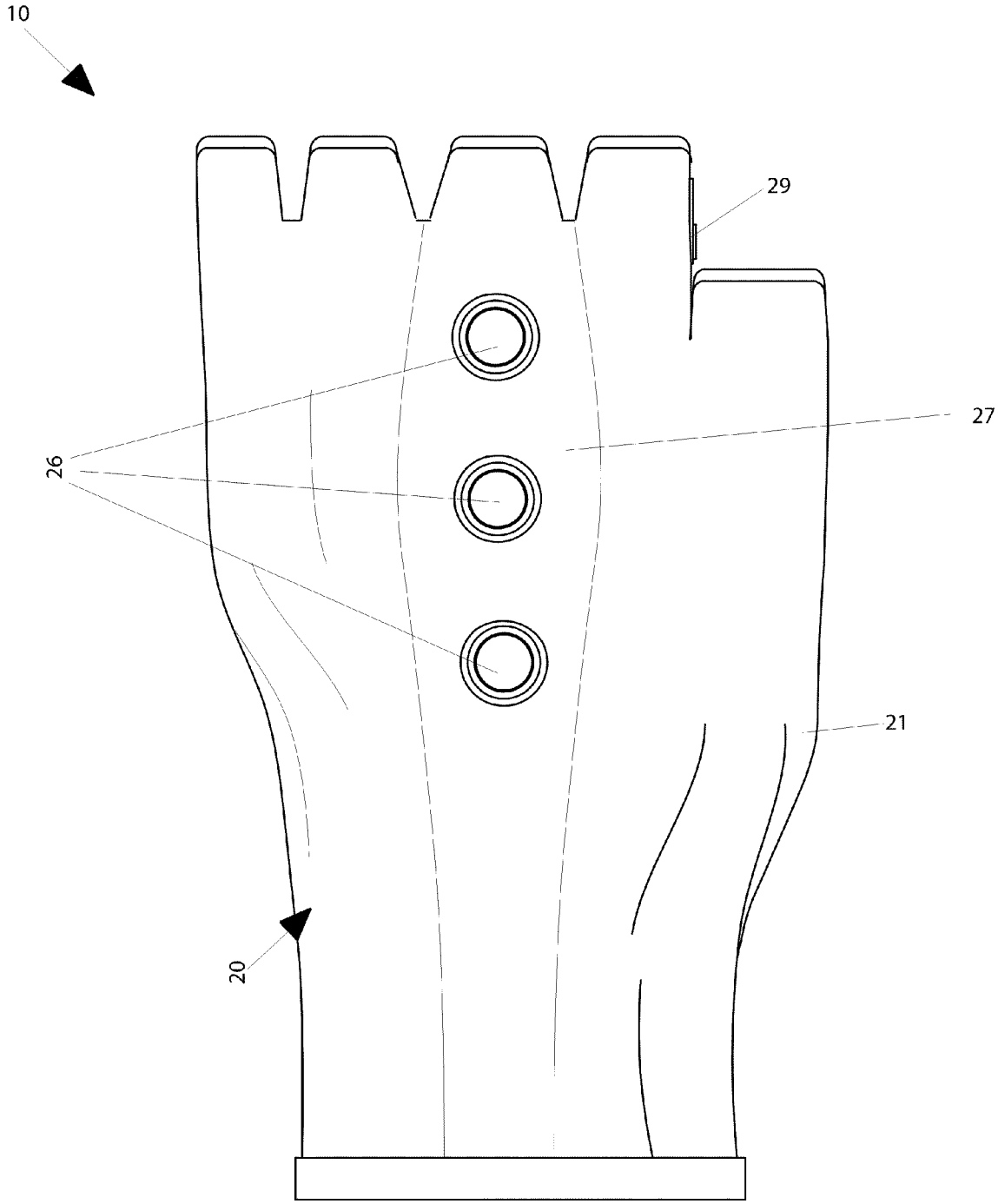
FIG. 2 is a top plan view showing the preferred embodiment of the of the illuminable hand signaling glove, in accordance with the present invention.
Figure 3:
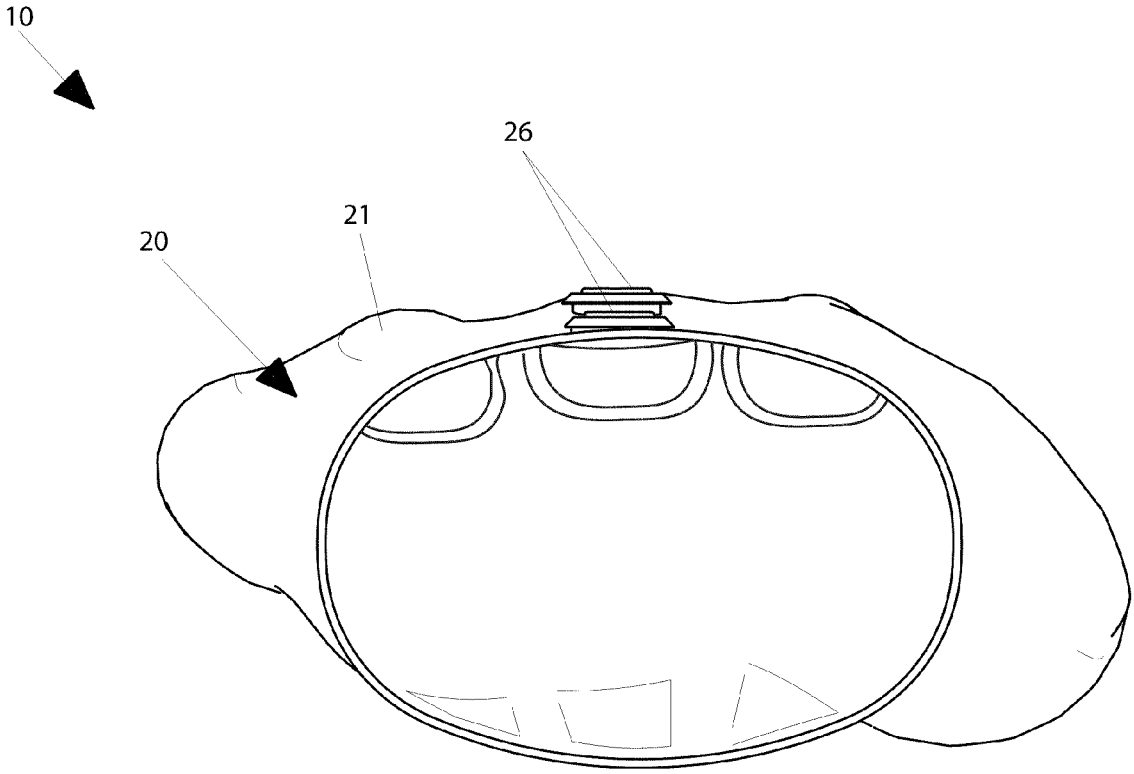
FIG. 3 is a rear elevational view showing the preferred embodiment of the illuminable hand signaling glove.
Figure 4:
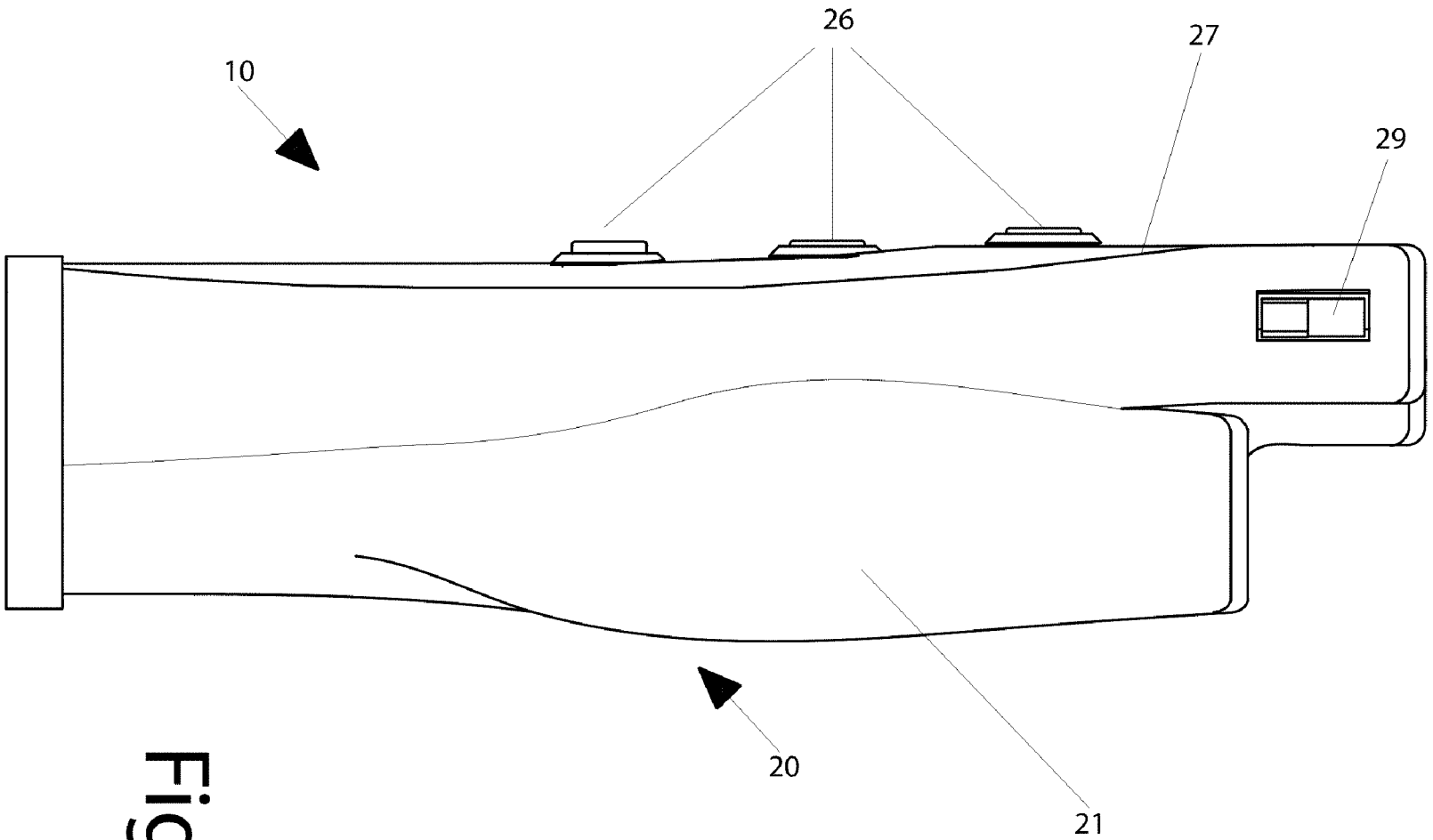
FIG. 4 is a side elevational view showing the preferred embodiment of the illuminable hand signaling glove.
Figure 5:
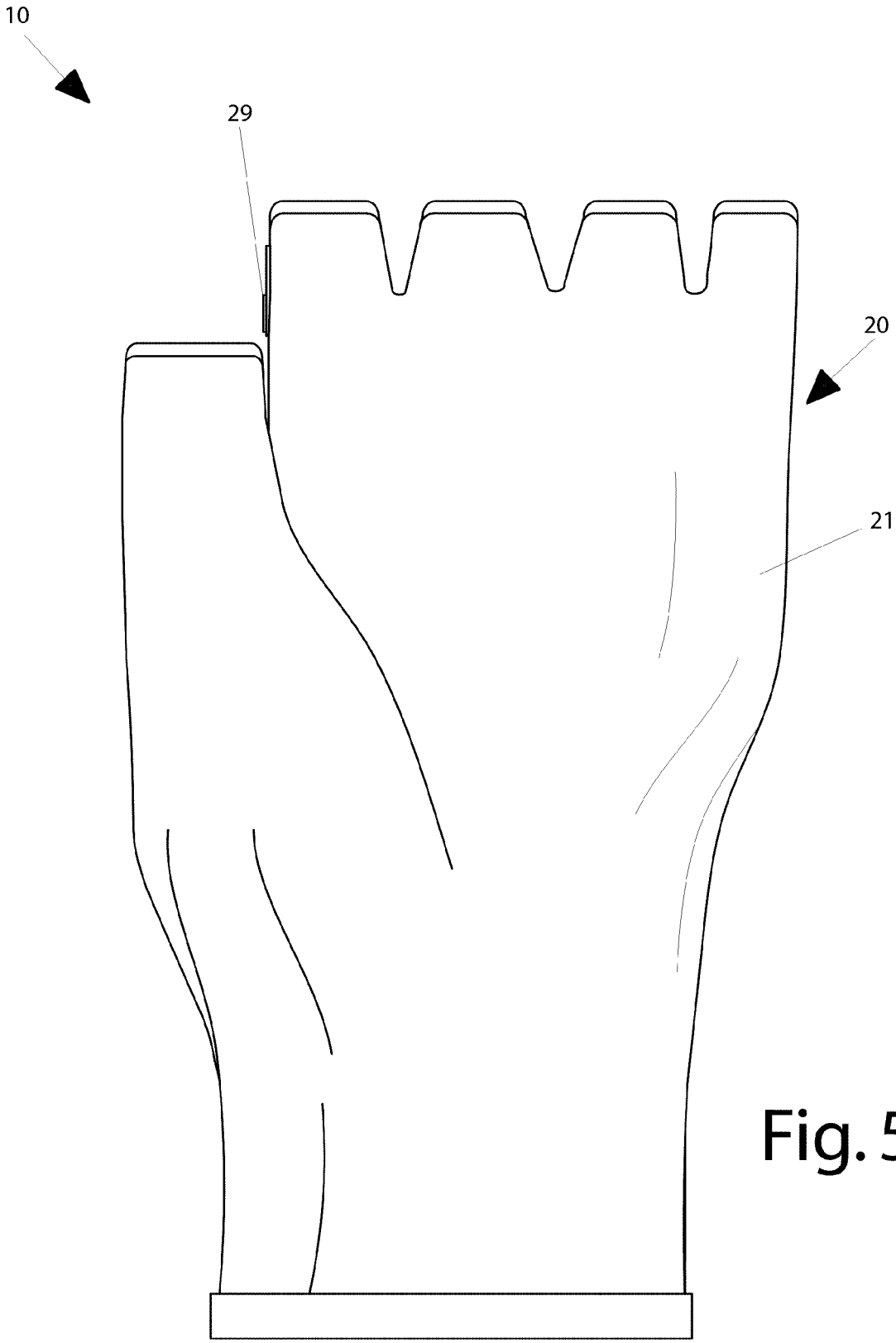
FIG. 5 is a bottom plan view showing the preferred embodiment of the illuminable hand signaling glove.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIG. 111 by the reference numeral 10 and is intended to provide an illuminable hand-signaling glove. It should be understood that the device 10 may be used as a signaling device for many different activities and should not be limited to use with only those types of activities mentioned herein.

The present invention may be practiced in a variety of embodiments. Referring initially to FIGS. 1A, 2, 3, 4, 5, 10 and 11, a preferred embodiment of an illuminable hand-signaling glove 10 preferably includes a body 20, adapted to be positioned at a hand region of the user. Such a body 20 may include a glove 21. In an alternate embodiment of the device 10''', 10'''', the body 20''', 20'''' may include a wrist band 22 and a plurality of finger bands 23 connected thereto. A first one of the finger bands 23A is preferably longitudinally oriented away from the wrist band 22 and may terminate distally therefrom. A second one of the finger bands 23B may be statically and removably conjoined to proximal and distal sections 24, 25 of the first finger band 23A respectively. The combination of such claimed elements provides an unpredictable and unexpected result which is not rendered obvious by one skilled in the art, wherein a user may effectively signal the intended travel path to oncoming cars or bystanders while continuously maintaining one hand on the bicycle handle bar at all times.

Referring to FIGS. 1A, 2, 3, 4, 5, 8, and 9, the preferred embodiment of the device 10, may further include a plurality of light-emitting sources 26 displayed on an exterior surface 27, of the body 20, and preferably juxtaposed along a uniform pattern. A mechanism 28 may be included for selectively toggling independent ones of the light-emitting sources 26 between illuminated and non-illuminated modes by selectively pivoting one metacarpal 12 of the user hand region 11 along a plurality of positions defined within the body 20, while maintaining remaining metacarpals 12 of the user hand region 11 at a static position. Such a selectively toggling mechanism 28 preferably includes a manually actuated user interface 29 attached to the exterior surface 27, of the body 20. The combination of such claimed elements provides an unpredictable and unexpected result which is not rendered obvious by one skilled in the art wherein a user may safely switch the light emitting sources 26 on and off using the gloved hand while continuously maintaining one hand on the bicycle handle bar at all times.

Figure 8:
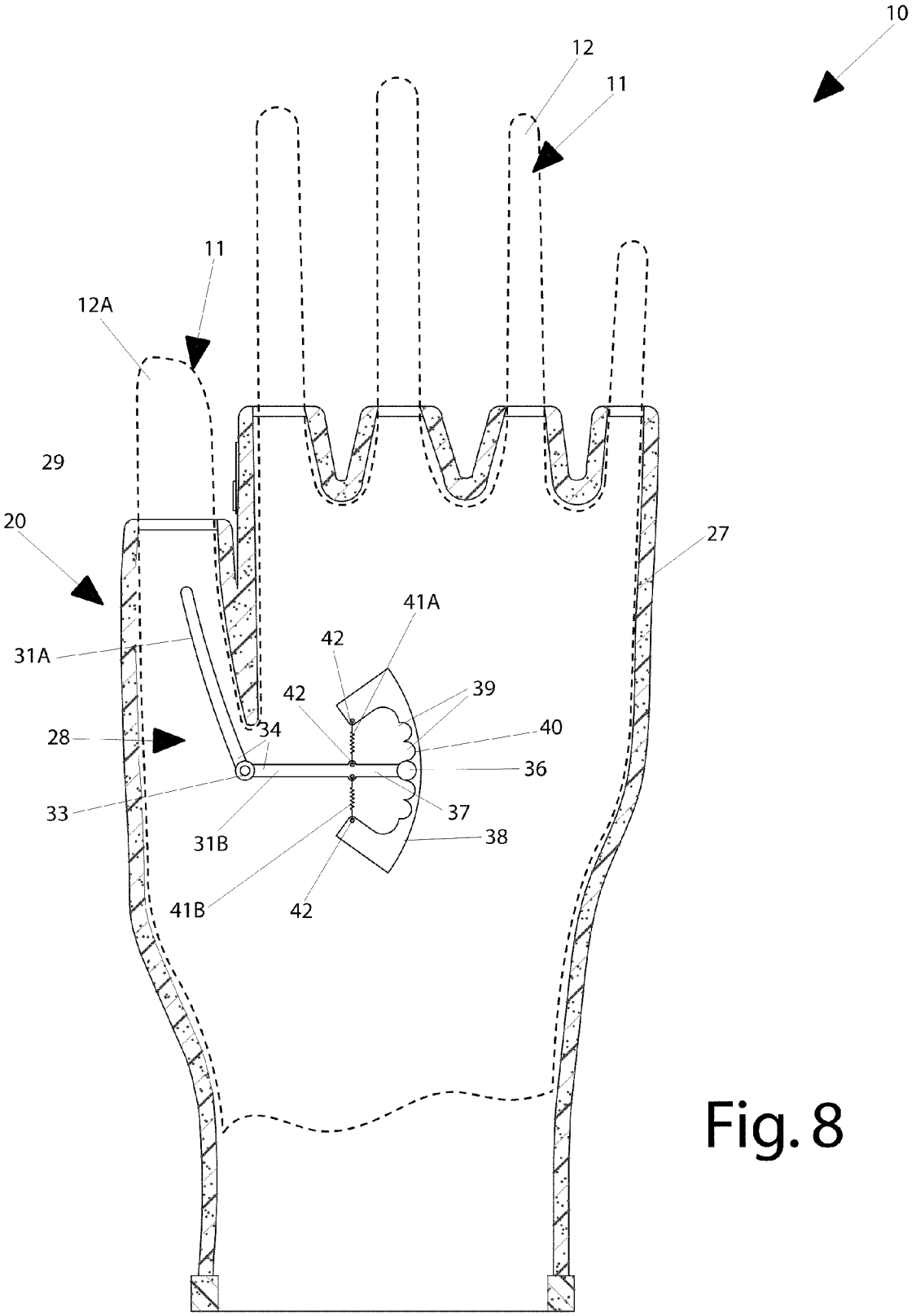
FIGS. 8 & 9 are cross sectional views showing the selectively toggling mechanism of the illuminable hand signaling glove.
Figure 9:
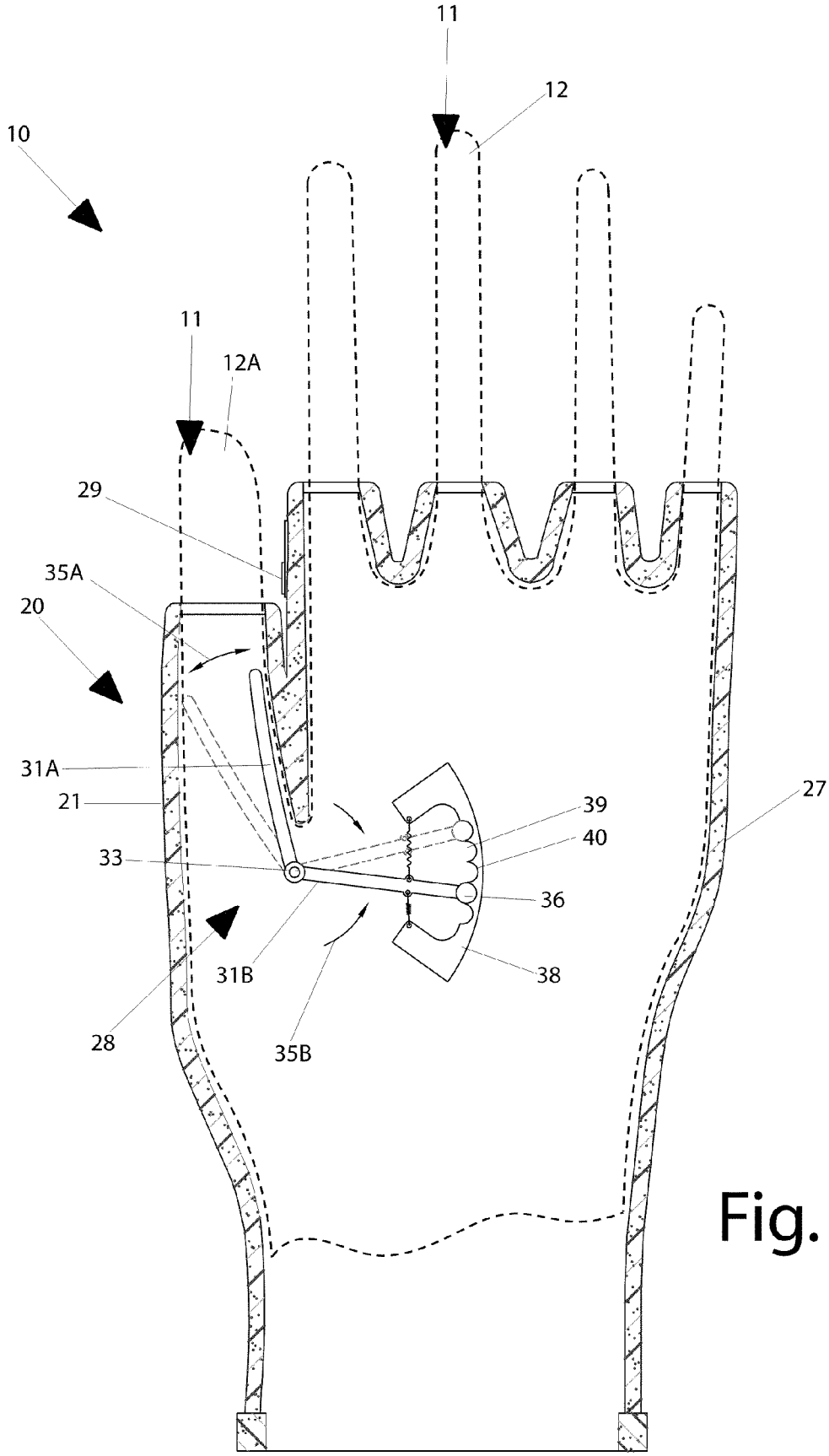

Referring to FIGS. 8 and 9, the selectively toggling mechanism 28 may further include an internal power source, not shown, first and second rectilinear levers 31A, 31B, seated inside a cavity of the body 20, and a pivot pin 33 cooperatively attached directly, without the use of intervening elements, to first ends 34 of the first and second levers 31A, 31B respectively and thereby may synchronously pivot the first and second levers 31A, 31B along mutually exclusive arcuate paths 35A, 35B defined with the cavity of the body 20. The mechanism 28 may further include a conductive head 36 fixedly coupled to a second end 37 of the second lever 31B and electrically attached to the internal power source, not shown, and a conductive manifold 38 preferably has a plurality of sockets 39 formed along an inner surface 40 thereof. The combination of such claimed elements provides an unpredictable and unexpected result which is not rendered obvious by one skilled in the art wherein a user may employ the device 10 without having to remain connected to a stationary power source.

Referring to FIGS. 8 and 9, the selectively toggling mechanism 28 may further include first and second deformably resilient spring members 41A, 41B anchored to oppositely facing flanges 42 of the conductive manifold 38 and the second lever 31B respectively. Such first and second spring members 41A, 41B are preferably respectively compressed and expanded as the second lever 31B is articulated along the second mutually exclusive arcuate path 35B which is important such that the second lever 31B is automatically returned to equilibrium when the one user metacarpal 12A is disengaged from the first lever 31A.

Referring again to FIGS. 8 and 9, the first lever 31A is preferably maintained in direct engagement with the one user metacarpal 12A which is essential such that the first lever 31A may be pivoted along a first one of the mutually exclusive arcuate paths 35A and thereby may cause the second lever 31B to synchronously pivot along a second one of the mutually exclusive arcuate paths 35B respectively. In addition, one of the sockets 39 is preferably formed from non-conductive material and may remain in direct abutment with the conductive head 36 while the first and second springs 41A, 41B as well as the second lever 31B may be at equilibrium and thereby preferably maintain the light-emitting sources 26 at the non-illuminated mode respectively.

Remaining ones of the sockets 39 may be formed from conductive material and may further be electrically coupled to a corresponding one of the light-emitting sources 26 respectively. The conductive head 36 is preferably selectively engaged with independent ones of the conductive sockets 39 when the second lever 31B is pivoted along the second mutually exclusive arcuate path 35B away from equilibrium and thereby may independently transmit power to the corresponding light-emitting sources 26 respectively. The combination of such claimed elements provides an unpredictable and unexpected result which is not rendered obvious by one skilled in the art, wherein the user will not be required to deactivate the light emitting sources 26, thus saving the life of the power source 30 while continuously maintaining one hand on the bicycle handle bar at all times.

Referring to FIG. 1B, in an alternate embodiment of the device 10" the body 20" may include a glove 21" wherein a single array of light emitting sources 26 may be displayed. Such an embodiment of the device 10" may be presented wherein the glove 21" features finger receiving sleeves 70.

Figure 6:
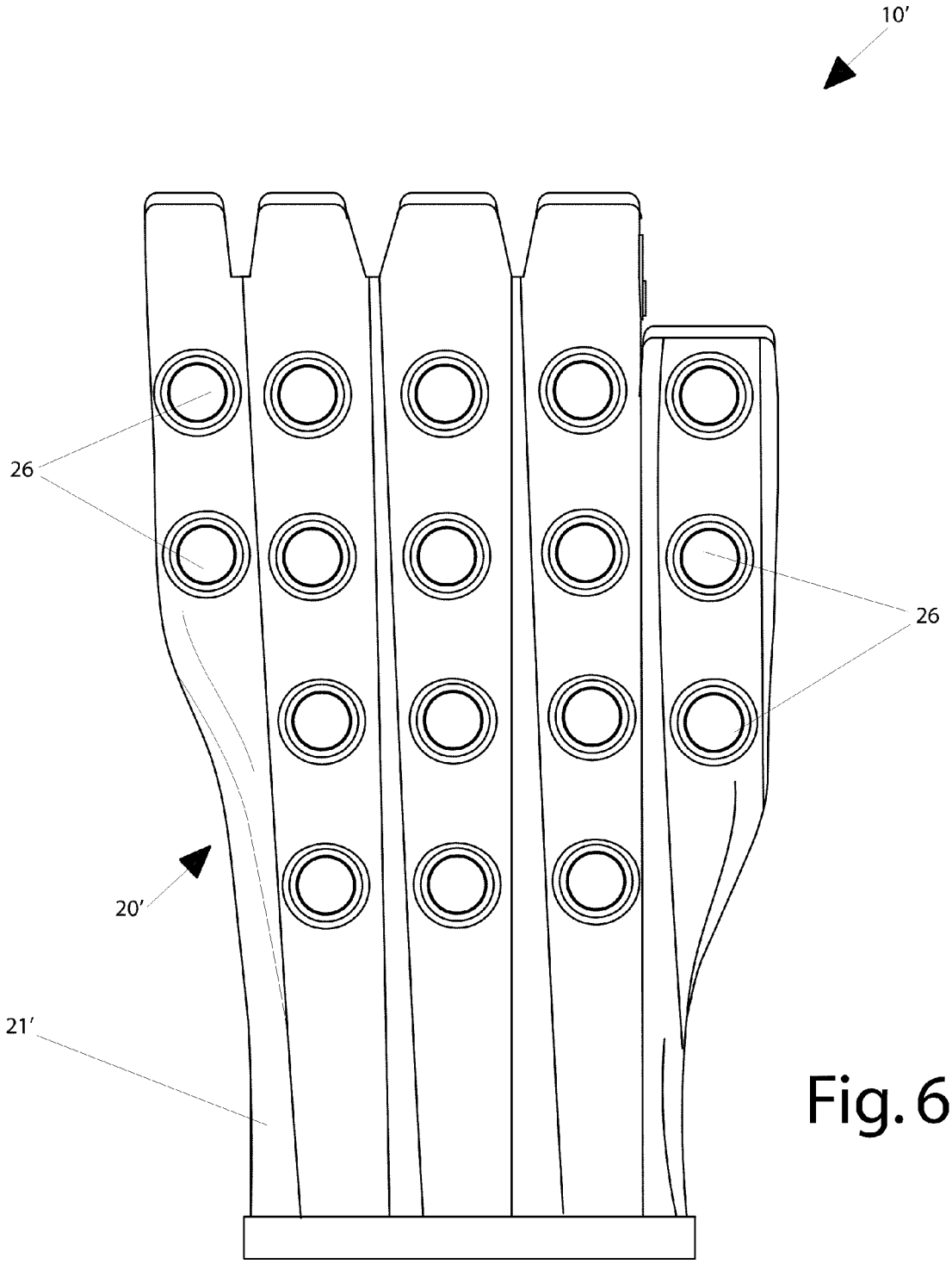
FIGS. 6 & 7 are top plan views showing additional alternative embodiments of the illuminable hand signaling glove wherein the light emitting sources are displayed in a variety of different patterns.
Figure 7:
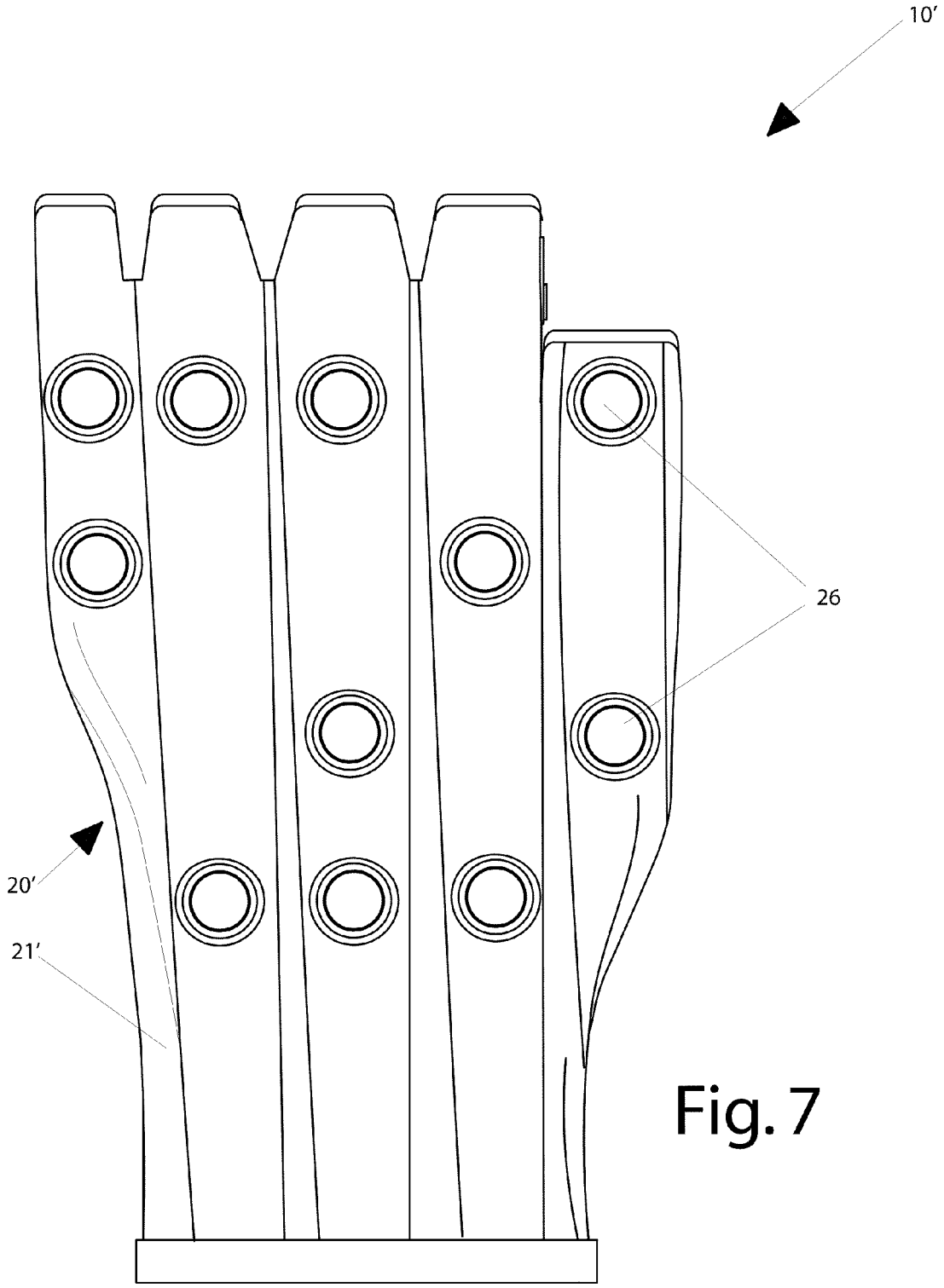

Referring to FIGS. 6 and 7, in another embodiment of the device 10', the body 20' may include a glove 21' with the light emitting sources 26 displayed in a variety of different patterns.

Figure 10:
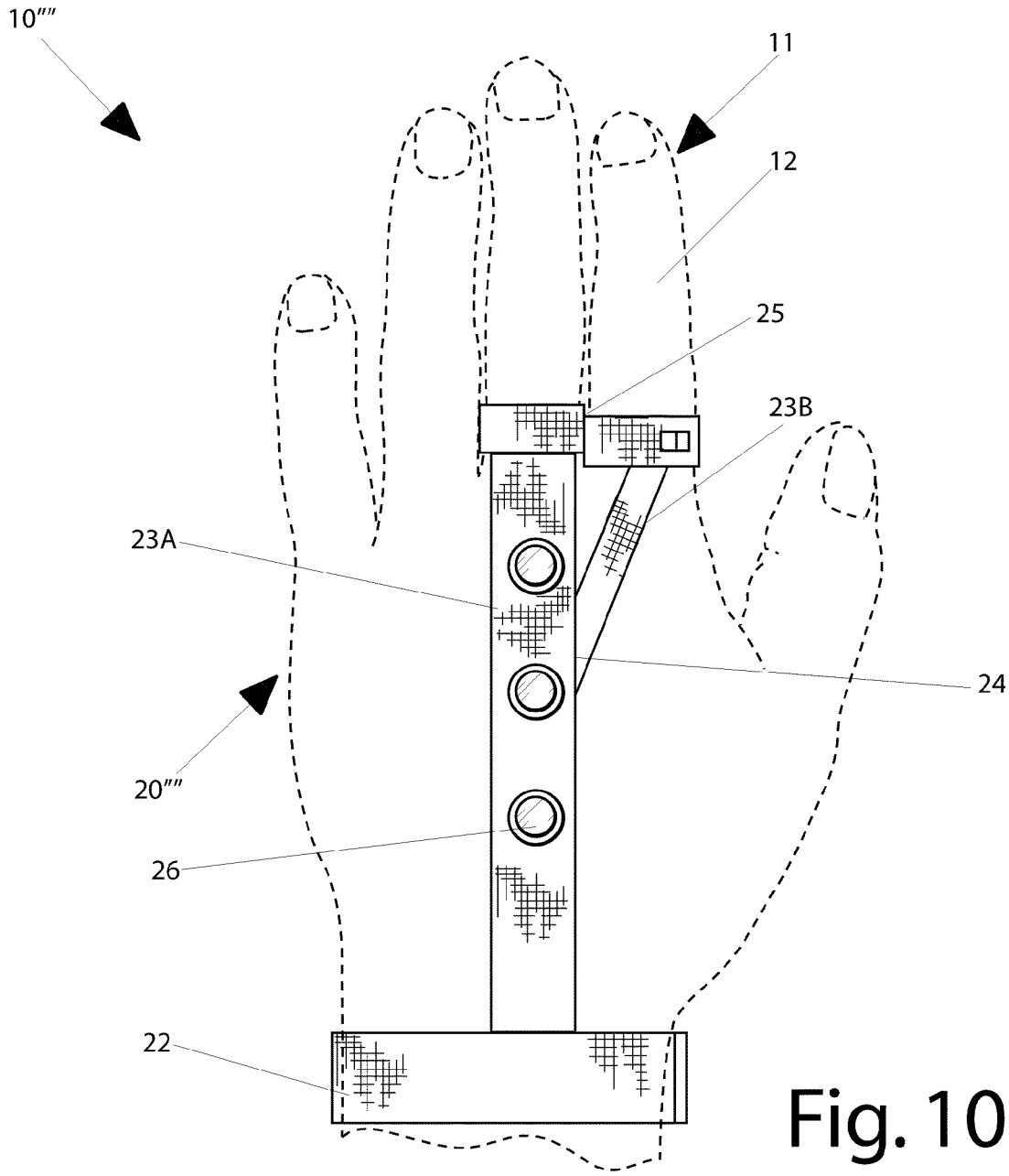
FIGS. 10 & 11 are top plan views showing additional alternate embodiments of the illumination hand signaling glove.
Figure 11:
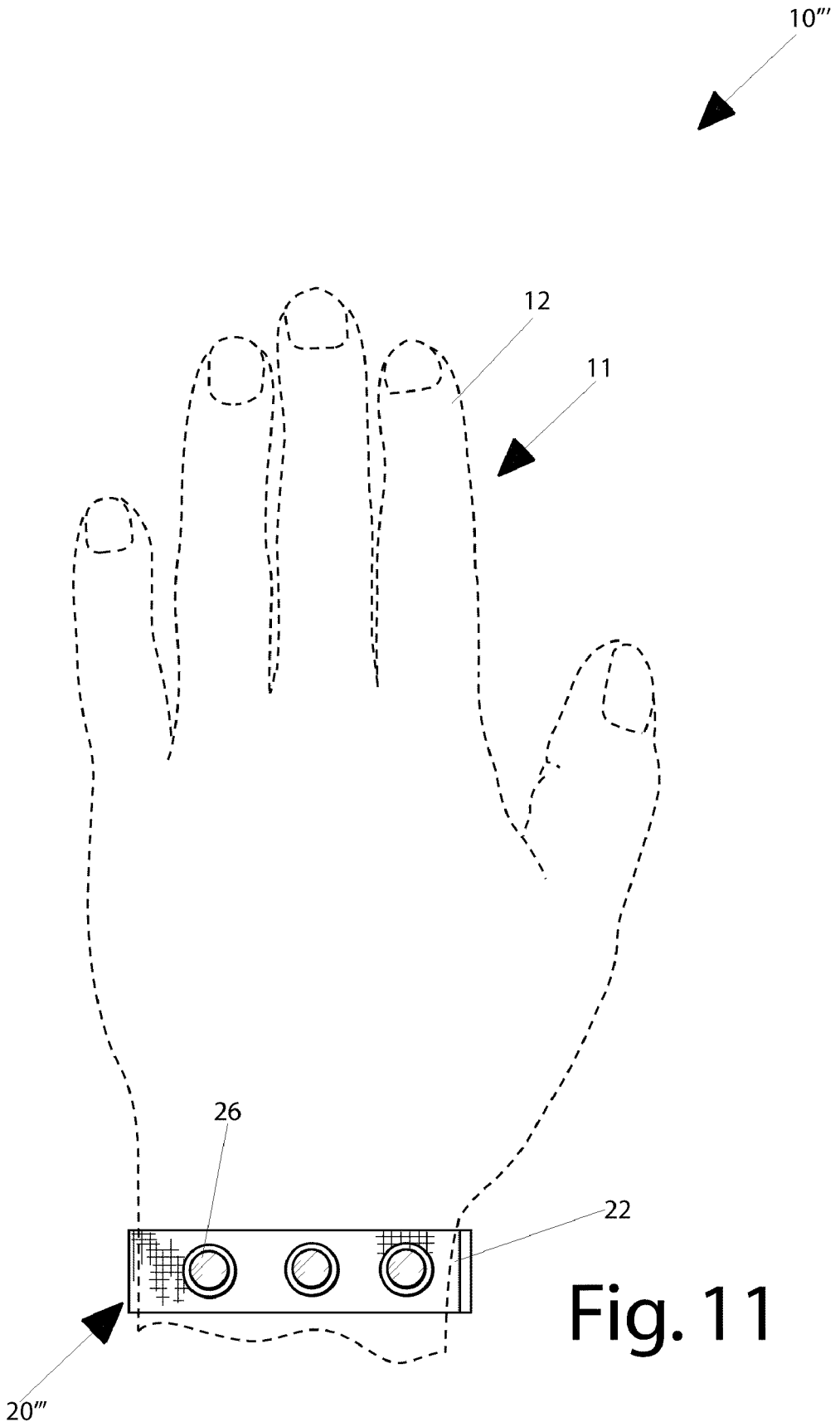

Referring to FIGS. 10 and 11, additional embodiments of the device 10''', 10'''' may include body 20''', 20'''' that preferably features a wrist band 22. The wrist band 22 may include the array of light emitting sources 26. The device 10'''' may also feature body 20'''' with a wrist band 22 and the plurality of finger bands 23 connected thereto. A first one of the finger bands 23A may include the array of light emitting sources 26 and may be longitudinally oriented away from the wrist band 22 and may terminate distally therefrom. The second one of the finger bands 23B may be statically and removably conjoined to proximal and distal sections of the first finger band 23A, respectively. This The device 10 preferably includes, in one embodiment, a glove 20 that is suitably sized and shaped to be worn by cyclists and motorists while operating their respective modes of transportation. A plurality of light-emitting sources 26 may be included for producing a sequence of different-colored flashing lights on the exterior surface 27 of the glove 20, which is important for attracting the attention of following motorists so that a user's hand-signals are clearly seen. Of course, the gloves 20 could be produced in a wide range of styles, sizes, colors and a variety of available materials, as is obvious to a person of ordinary skill in the art.

The present invention, as claimed, provides the unexpected and unpredictable benefit of a device that is convenient and easy to use, is durable yet lightweight in design, is versatile in its applications, and provides users with a strong visual amplification of their traffic hand-signals. With use of the present invention, cyclists can better communicate between themselves and other persons on the road, be it a pedestrian, vehicle operator or another cyclist. To be effective, hand signal communication must not only be transmitted, but received and understood. By emitting a stronger signal, the signal is more likely to be received and understood, and in this regard, the present invention clearly makes hand-signals a stronger, more visible communication. At night, at dusk or dawn, and in inclement weather, ordinary hand signals can easily be missed by other operators. The device effectively eliminates this shortcoming by providing a bright signaling means that can be seen from all lines of sight.

In use, a preferable method for illuminating a hand-signaling glove 10 and thereby displaying an intended user travel path may include the steps of: providing a body 20; providing and juxtaposing a plurality of light-emitting sources 26 along a uniform pattern by displaying the light-emitting sources 26 on an exterior surface 27 of the body 20; providing and attaching a manually actuated user interface 29 to the exterior surface 27 of the body 20; positioning the body 20 at a hand region 11 of the user; and selectively toggling independent ones of the light-emitting sources 26 between illuminated and non-illuminated modes by selectively pivoting one metacarpal 12A of the user hand region 11 along a plurality of positions defined within the body 20 while maintaining remaining metacarpals 12 of the user hand region 11 remain at a static position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An illuminable hand-signaling glove for displaying an intended user travel path, said illuminable hand-signaling glove comprising:

a body adapted to be positioned at a hand region of the user;

a plurality of light-emitting sources displayed on an exterior surface of said body and being juxtaposed along a uniform pattern; and means for selectively toggling independent ones of said light-emitting sources between illuminated and non-illuminated modes by selectively pivoting one metacarpal of the user hand region along a plurality of positions defined within said body while maintaining remaining metacarpals of the user hand region at a static position.

2. The illuminable hand-signaling glove of claim 1, wherein said selectively toggling means further comprises:

first and second rectilinear levers seated inside a cavity of said body;

a pivot pin cooperatively attached directly to first ends of said first and second levers respectively and thereby synchronously pivoting said first and second levers along mutually exclusive arcuate paths defined with said cavity of said body;

a conductive head fixedly coupled to a second end of said second lever; and a conductive manifold having a plurality of sockets formed along an inner surface thereof; and first and second deformably resilient spring members anchored to oppositely facing flanges of said conductive manifold and said second lever respectively;

wherein said first lever is in direct engagement with the one user metacarpal such that said first lever is pivoted along a first one of said mutually exclusive arcuate paths and thereby causing said second lever to synchronously pivot along a second one of said mutually exclusive arcuate paths respectively.

3. The illuminable hand-signaling glove of claim 2, wherein said first and second spring members are respectively compressed and expanded as said second lever is articulated along said second mutually exclusive arcuate path such that said second lever is automatically returned to equilibrium when the one user metacarpal is disengaged from said first lever.

4. The illuminable hand-signaling glove of claim 3, wherein one of said sockets is formed from non-conductive material and remains in direct abutment with said conductive head while said first and second springs as well as said second lever are at equilibrium and thereby maintaining said light-emitting sources at the non-illuminated mode respectively.

5. The illuminable hand-signaling glove of claim 4, wherein remaining ones of said sockets that are formed from conductive material and are electrically coupled to a corresponding one of said light-emitting sources respectively, said conductive head being selectively engaged with independent ones of said conductive sockets when said second lever is pivoted along said second mutually exclusive arcuate path away from equilibrium and thereby independently transmitting power to said corresponding light-emitting sources respectively.

6. The illuminable hand-signaling glove of claim 1, wherein said body comprises: a glove.

7. An illuminable hand-signaling glove for displaying an intended user travel path, said illuminable hand-signaling glove comprising:

a body adapted to be positioned at a hand region of the user;

a plurality of light-emitting sources displayed on an exterior surface of said body and being juxtaposed along a uniform pattern; and means for selectively toggling independent ones of said light-emitting sources between illuminated and non-illuminated modes by selectively pivoting one metacarpal of the user hand region along a plurality of positions defined within said body while maintaining remaining metacarpals of the user hand region at a static position;

wherein said selectively toggling means comprises a manually actuated user interface attached to said exterior surface of said body.

8. The illuminable hand-signaling glove of claim 7, wherein said selectively toggling means further comprises:

first and second rectilinear levers seated inside a cavity of said body;

a pivot pin cooperatively attached directly to first ends of said first and second levers respectively and thereby synchronously pivoting said first and second levers along mutually exclusive arcuate paths defined with said cavity of said body;

a conductive head fixedly coupled to a second end of said second lever; and a conductive manifold having a plurality of sockets formed along an inner surface thereof; and first and second deformably resilient spring members anchored to oppositely facing flanges of said conductive manifold and said second lever respectively;

wherein said first lever is in direct engagement with the one user metacarpal such that said first lever is pivoted along a first one of said mutually exclusive arcuate paths and thereby causing said second lever to synchronously pivot along a second one of said mutually exclusive arcuate paths respectively.

9. The illuminable hand-signaling glove of claim 8, wherein said first and second spring members are respectively compressed and expanded as said second lever is articulated along said second mutually exclusive arcuate path such that said second lever is automatically returned to equilibrium when the one user metacarpal is disengaged from said first lever.

10. The illuminable hand-signaling glove of claim 9, wherein one of said sockets is formed from non-conductive material and remains in direct abutment with said conductive head while said first and second springs as well as said second lever are at equilibrium and thereby maintaining said light-emitting sources at the non-illuminated mode respectively.

11. The illuminable hand-signaling glove of claim 10, wherein remaining ones of said sockets that are formed from conductive material and are electrically coupled to a corresponding one of said light-emitting sources respectively, said conductive head being selectively engaged with independent ones of said conductive sockets when said second lever is pivoted along said second mutually exclusive arcuate path away from equilibrium and thereby independently transmitting power to said corresponding light-emitting sources respectively.

12. The illuminable hand-signaling glove of claim 7, wherein said body comprises: a glove.

13. A method for illuminating a hand-signaling glove and thereby displaying an intended user travel path, said method comprising the chronological steps of:

a. providing a body;

b. providing and juxtaposing a plurality of light-emitting sources along a uniform pattern by displaying said light-emitting sources on an exterior surface of said body;

c. providing and attaching a manually actuated user interface to said exterior surface of said body;

d. positioning said body at a hand region of the user; and e. selectively toggling independent ones of said light-emitting sources between illuminated and non-illuminated modes by selectively pivoting one metacarpal of the user hand region along a plurality of positions defined within said body while maintaining remaining metacarpals of the user hand region at a static position.

* * * * *